US005377657A

United States Patent [19]

Foster et al.

[11] Patent Number: 5,377,657

[45] Date of Patent: Jan. 3, 1995

[54] ARCHERY BOW HOLDER

[76] Inventors: Gary D. Foster, 5806 Monassas Run, Milford, Ohio 45150; Curtis C. Foster, 2623 Nola Dr., Bethel, Ohio 45106

[21] Appl. No.: 200,302

[22] Filed: Feb. 23, 1994

Related U.S. Application Data

[63] Continuation of Ser. No. 090,635, Jul. 12, 1993, abandoned, which is a continuation of Ser. No. 802,032, Dec. 3, 1991, abandoned.

[51] Int. Cl.[6] ..... F41B 5/00

[52] U.S. Cl. ..... 124/86; 124/88; 124/23.1

[58] Field of Search ..... 124/86, 88, 23.1, 25.6, 124/24.1; 248/299, 538, 514, 309

[56] References Cited

U.S. PATENT DOCUMENTS

| | | | |
|---|---|---|---|
| D. 299,199 | 1/1989 | Rogowski . | |
| 2,220,234 | 11/1940 | Hadaway | 248/538 |
| 2,690,317 | 9/1954 | Hoffmann | 248/514 |
| 4,331,311 | 5/1982 | Russell . | |
| 4,360,179 | 11/1982 | Roberts | 248/309.1 X |
| 4,531,643 | 7/1985 | Bradley | 248/538 X |
| 4,542,873 | 9/1985 | Matherly et al. . | |
| 4,614,323 | 9/1986 | Bauer | 248/538 |
| 4,729,363 | 3/1988 | Skyba | 124/23.1 |
| 4,936,415 | 6/1990 | Williams . | |
| 5,048,504 | 9/1991 | Ballard | 124/24.1 X |

*Primary Examiner*—Eric K. Nicholson
*Assistant Examiner*—Anthony Knight
*Attorney, Agent, or Firm*—Richard C. Litman

[57] ABSTRACT

An archery bow holder for compound bows is formed of an upper assembly frame attached to a convex curved lower plate. The lower plate has an elongated slot for adjustment and closely fits with a base plate having a concave upper surface and passage for a bolt. The holder may be installed upon a hunter's tree stand or any other suitable surface with a bolt and cooperating nut, and arcuate adjustment for different bows or non level surfaces is provided by the mating curved surfaces of the slotted lower plate and base. The entire assembly including the base may be pivoted about the axis formed by the bolt for alignment as desired. Thus, a single bolt provides for the attachment, arcuate adjustment, and pivotal adjustment of the bow holder. At least some portions of the assembly may be covered or coated with a resilient coating or covering in order to protect a bow being held therein, and also to reduce or prevent noise if the otherwise hard surface of the bow holder were to be struck by another article.

8 Claims, 1 Drawing Sheet

ARCHERY BOW HOLDER

The present application is a continuation-in-part of application Ser. No. 08/090,635, filed Jul. 12, 1993, now abandoned, which is a continuation of application Ser. No. 08/802,032, filed Dec. 3, 1991, now abandoned.

FIELD OF THE INVENTION

This invention relates generally to holders and fixtures, and more specifically to an easily installable and adjustable holder or support for archery bows which is secureable to a horizontal surface, such as a hunter's tree stand, and which provides generally upright support for an archery bow held therein.

BACKGROUND OF THE INVENTION

Hunters, particularly those who prefer to hunt using archery equipment, increasingly employ various advantages in the art. One of these advantages is the use of a tree stand, which serves to elevate the hunter above the normal horizontal line of sight of the game and provide the hunter with a wider field of view.

However, many archery hunters find the use of tree stands to be inconvenient at the vary least, due to the fact that such stands tend to be relatively small in order to provide for portability and ease of setup. The relatively small size tends to preclude the storage of any significant amount of equipment by the time a hunter has positioned himself upon the stand. Obviously, there is no adjacent ground or other surface to use for the placement of such equipment when such a stand has been erected in a tree.

When a hunter must remain in position for perhaps several hours, it is most inconvenient to hold a bow or other equipment at the ready at all times. Some have partially solved the problem by hanging the bow upon a short branch or even a nail driven into the tree, but this presents potential problems if the bow is not carefully removed to avoid damage, as well as the fact that additional equipment must be provided in order to drive a nail and moreover many hunters find the damage to a tree from the use of a nail to be unacceptable.

While some supports have been developed in order to attempt to overcome the above problems, they are generally relatively cumbersome to sue and costly to manufacture. The need arises for an archery bow holder for use in hunting, which holder may be easily secured to a level surface in order to hold a bow for ready use by a hunter. The holder should provide adjustment for various bow types and configurations, and moreover should be easily attachable, detachable and adjustable using a minimum of separate components and fasteners.

DESCRIPTION OF THE RELATED ART

C. J. Russel U.S. Pat. No. 4,331,311 discloses a holder for compound bows which includes three separately attachable and adjustable components mounted to a base. The base must then be attached to yet another surface for support.

J. F. Matherly et al. U.S. Pat. No. 4,542,873 discloses a bow holder which provides a spring loaded member for securing the bow in the holder. This device does not appear particularly suitable for use with a compound bow, and moreover requires a considerable number of separate components, as in the case of the Russell patent cited above.

R. D. Williams U.S. Pat. No. 4,936,415 discloses an archery bow holder adaptable to a tree stand having a floor comprising a series of parallel spaced apart rails. One part of the bow holder hooks under one of the rails, while the remaining portion overlies the top surface of one or more other rails. While adjustment is provided, no mean is provided for securing the holder to the tree stand as the stand is installed in a tree. As the tree stand floor is maneuvered at various angles, the Williams bow holder may easily slip from its installed position.

A. M. Rogowski U.S. Pat. No. D-299,199 discloses a design for a bow holder. No function is disclosed, nor is any adjustment means apparent from the appearance of the design.

None of the above noted patents, either singly or in combination, are seen to disclose the specific arrangement of concepts disclosed by the present invention.

SUMMARY OF THE INVENTION

By the present invention, an improved holder or support for archery bows is disclosed.

Accordingly, one of the objects of the present invention is to provide an improved archery bow holder which is attachable to a hunter's tree stand or any other suitable surface.

Another of the objects of the present invention is to provide an improved archery bow holder which may be used with compound archery bows.

A further object of the present invention is to provide an improved archery bow holder which provides essentially upright support for a bow held therein.

Yet another object of the present invention is to provide an improved archery bow holder which may be adjusted to hold different bows.

Still another object of the present invention is to provide an improved archery bow holder which comprises a minimal number of separate components.

An additional object of the present invention is to provide an improved archery bow holder which provides for attachment and adjustability with a single fastener.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
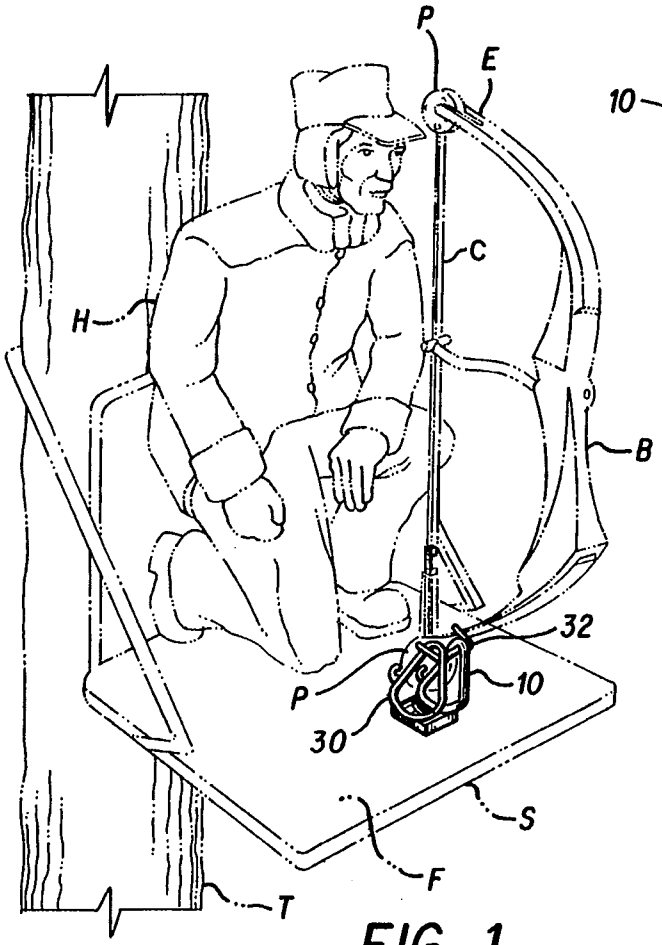
FIG. 1 is a perspective view of the present invention in use.

Referring now to the drawings, particularly FIG. 1 of the drawings, the present invention will be seen to relate to an archery bow holder 10 for the support of hunting or other archery bows, particularly compound bows such as bow B of FIG. 1. Typical compound bows such as bow B include pulleys P at each end E of the bow B, over which the bow string C is passed or secured. In many such compound bows at least one of the pulleys P is eccentric, providing further leverage as the bow B is drawn. In any case, the ends E of the bow B are bifurcated in order to contain the axis for such a pulley P therebetween, as in the case of the bow B illustrated in the accompanying drawing figures.

Figure 3:
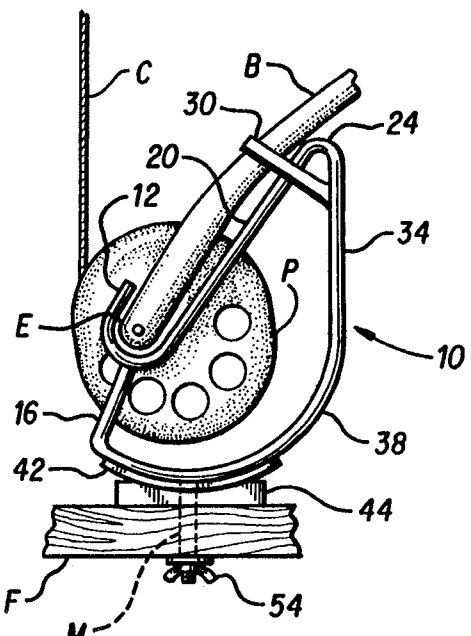
FIG. 3 is a side elevation of the present invention installed in a level planar surface, showing the lower portion of a compound bow installed therein.
Figure 2:
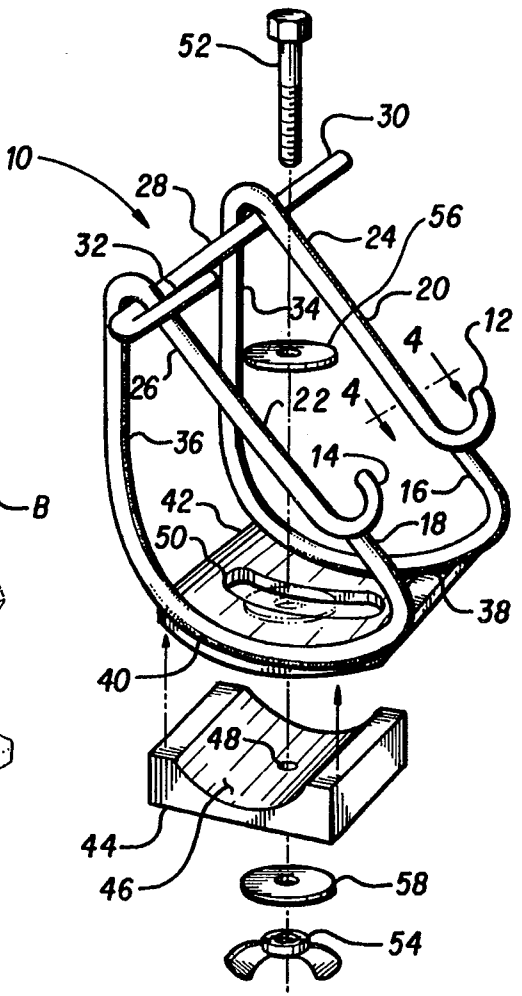
FIG. 2 is an exploded perspective view illustrating the various components and their relationship.

Accordingly, bow holder 10 is provided with two spaced apart retaining hooks 12 and 14 to contain the bifurcated ends E of a bow B, more clearly shown in FIGS. 2 and 3. Bow holder 10 is constructed of a material that is incapable of being bent manually. Hooks 12 and 14 extend respectively from the lower portions 16 and 18 of side members 20 and 22, thus serving to provide support for the bifurcated ends E of bow B. The pulley P contained between the bifurcated bow B end E, being substantially wider than the bow B ends E, will serve to prevent the ends E of bow B from slipping laterally from the spaced apart hooks 12 and 14.

The upper ends 24 and 26 of spaced apart side members 20 and 22 have a cross member 28 extending therebetween. Cross member 28, and/or upper ends 24 and 26, provide a retaining rest for the bow B portion above pulley P. Upper retainers 30 and 32 also extend from each end of cross member 28 respectively adjacent side members 20 and 22, thus serving to further retain bow B laterally.

Figure 4:
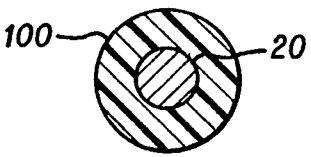
FIG. 4 is a cross sectional view through line 4—4 of FIG. 2, showing the resilient padding overlaying the structure.

Bow holder 10 may be provided with some form of resilient padding or coating 100 to protect the surfaces of a bow B resting thereupon as shown covering the section of side member 20 of bow holder 10 in FIG. 4, as shown covering the section of the side member 20 of the bow holder 10 in FIG. 4. Another important provision of such a sound deading and padded resilient coating 100 is to prevent or reduce any noise and/or vibrations which might be caused by a bow B or other article striking the otherwise hard surface of bow holder 10; this is an important consideration in hunting since noise and/or vibrations affect the accuracy of archery shooting. Such padding may be in the form of a resilient plastic or elastomer coating over at least the portions of bow holder 10 which would be in contact with a bow B, or may be of any other suitable form and may cover the entire bow holder 10 if desired, as shown by the relative thickness of the various components in the drawing figures. The coating 100 used in the prototype of the present invention is a material known by the trade name of PLASTISOL, which material is applied as a liquid in a heated condition and cools to form a solid resilient plastic coating. As noted above, any equivalent padding or coating material may be substituted.

Forward members 34 and 36 extend downward respectively from the upper ends 24 and 26 of side members 20 and 22. These forward members 34 and 36 continue downward and rearward to form arcuately convex lower members 38 and 40, which continue rearward to join respectively with the lower ends 16 and 18 of side members 20 and 22.

Arcuately convex lower members 38 and 40 provide further for the attachment of a similarly shaped arcuately convex lower plate 42 which extends laterally between lower members 38 and 40. The foregoing described components comprise an upper assembly which by means of plate 42 may cooperate with abase 44, which base 44 is provided with an upwardly concave upper surface 46 which will be seen to cooperate closely with the convex lower surface of plate 42.

Base 44 will be seen to contain a centrally positioned mounting hole 48 which provides for the attachment of base 44, and the remaining components of bow holder 10, to an appropriate surface. FIG. 1 shows bow holder 10 secured to the floor F of a tree stand S, while FIG. 3 provides a detail view of that attachment. Lower plate 42 contains a centrally located slot 50 which provides for the adjustable securing of bow holder 10 to a surface such as tree stand floor F, as will be explained below. Attachment hardware, such as bolt 52, nut 54, and upper and lower washers 56 and 58 may be used to secured bow holder 10 to the desired surface.

Bow holder 10 is typically assembled to the floor F of a tree stand S as shown in FIGS 1 and 3. This may be accomplished either before the stand S is installed in a tree T, as is shown in FIG. 1, or after the installation of the tree stand S in a tree T. Bow holder 10 is sufficiently compact that is may easily be carried in a pocket or other container which a hunter H might provide, and be installed on tree stand S after the stand is erected. Bow holder 10 is installed by loosely fitting base 44 into a cooperating alignment with lower plate 42, placing the assembly over a suitable mounting hole M in a surface or floor F in a manner that hole M, hole 48 within base 44, and slot 50 of lower plate 42 are aligned, positioning upper and lower washers 56 and 58 into position in alignment with components 42, 44 and floor F, and placing bolt 52 therethrough and installing nut 54 upon bolt 52.

Holder 10 is preferably secured in a position provided that the extreme lower ends E of a bow B contained therein will be retained by hooks 12 and 14, and the portion of the bow B extending upward therefrom will be oppositely retained by side member upper ends 24 and 26, and/or cross member 28. By properly assembling and adjusting bow holder 10, the greater mass of bow B will be forward of bow holder 10 and will thus urge the extreme lower ends E downward and rearward to form a cooperating retention of the lower ends E of bow B by retaining hooks 12 and 14. The mass of bow B will also urge the portion of bow B resting against upper portions 24 and 26 of side members 20 and 22, and/or cross member 28, forward against those embers and thus retain bow B in a stable, cantilevered and essentially vertical position within bow holder 10.

The adjustment of bow holder 10 for different bows B, or possibly a non level mounting surface or floor F, may be accomplished by merely loosening nut 54 on bolt 52, and arcuately sliding lower plate 42 within the cooperating concave upper surface 46 of base 44. The elongated slot 50 will be seen to closely cooperate laterally with bolt 52, while allowing the arcuate repositioning of lower plate 42 relative to base 44. When the desired position of the upper portions of bow holder 10 relative to base 44 is reached, nut 54 may be tightened upon bolt 52 to lock lower plate 42 and the assembly in position relative to base 44 and floor F. It will be seen that the single bolt 52 which provides for both attachment and adjustment for bow holder 10, will also permit bow holder 10 to be pivotally positioned as desired. Thus, a hunter H may loosen nut 54 on bolt 52 and pivot bow holder 10 relative to a mounting surface such as floor F in order to cause bow B to face directly away, to the left, right, or as desired. The desired position may be maintained by securing nut 54 upon bolt 52 as described above. If the removal of bow holder 10 from stand S is desired, this may be easily accomplished by removing nut 54 from bolt 52 and withdrawing bolt 52 from the remaining components, which components may then be removed from floor F for storage as desired.

It is anticipated that a hunter H may wish to leave bow holder 10 permanently installed upon the floor F of a tree stand S, in which case the attachment hardware such as bolt 52 and nut 54 may be provided with securing means cooperating with standard wrenches as in the case of the hexagonal head of bolt 52 shown in FIG. 2. However, it may be desirable to provide for each of adjustment, assembly and/or disassembly of bow holder 10 in the field, where the carriage of the proper wrenches or tools may be inconvenient. Thus, some persons may find the wing nut 54 as shown in FIGS. 2 and 3 to be a more desirable alternative, as no tools will be required for adjustment, assembly or disassembly of bow holder 10.

It is to be understood that the present invention is not limited to the sole embodiment described above, but encompasses any and all embodiments within the scope of the following claims.

I claim:

1. An archery bow holder attachable to a flat surface of a floor of a tree stand for supporting a hunter when positioned in a tree and providing substantially vertical support for an archery compound bow, said bow holder comprising:

a base having an arcuately concave upper surface and a passage for a single fastener extending therethrough;

an upper assembly composed of a material incapable of being bent manually, said upper assembly comprising:

two spaced apart retaining hooks, two spaced apart side members respectively integral with said retaining hooks and extending upward and forward from said retaining hooks, said two retaining hooks and two side members are spaced apart a distance sufficient to support the compound bow having at least one bifurcated bow end with a pulley installed therein, a cross member extending transversely between and connected to said side members and having upturned end portions extending rearwardly which form guides to receive and retain the compound bow securely in the bow holder, two spaced apart forward members respectively integral with said side members and extending downward and rearward from said side members to form two spaced apart arcuately convex lower members; and an arcuately convex lower plate cooperable with said arcuately concave upper surface of said base and connected to said spaced apart arcuately convex lower members, said lower plate containing an elongated slot, said upper assembly being adjustably secured to said base by said single fastener with said lower plate cooperating with said arcuately concave upper surface of said base, and said bow holder being further adjustably secured to said flat surface by said single fastener.

2. The archery bow holder of claim 1 wherein:

said upper assembly is arcuately adjustable relative to said base by means of said slot in said convex lower plate cooperating with said single fastener extending through said base.

3. The archery bow holder of claim 1 wherein:

said single fastener comprises a pivotal axis whereby said archery bow holder may be pivotally adjusted.

4. The archery bow holder of claim 1 wherein:

said single fastener provides for assembly, arcuate adjustment and pivotal adjustment of said archery bow holder.

5. The archery bow of claim 1 wherein:

at least said upper assembly includes a sound deadening and padded resilient coating disposed thereupon whereby;

noise produced by another article striking said archery bow holder upper assembly, is reduced.

6. The archery bow holder of claim 5 wherein:

said resilient coating comprises a plastic coating.

7. The archery bow holder of claim 5 wherein:

said resilient coating comprises an elastomer coating.

8. An archery bow holder attachable to a flat surface of a tree stand for supporting a hunter when positioned in a tree and providing a stable, cantilevered and substantially upright support for an archery compound bow unit having at least one bifurcated bow end with a pulley installed therein, said bow holder comprising;

a single fastener having a pivotal axis whereby the archery compound bow unit being pivotally adjusted, said bow holder being adjustably secured to the flat surface by said single fastener, a base having an arcuately upper surface and a passage for said single fastener extending therethrough, an upper assembly composed of a material incapable of being bent manually, said upper assembly including:

two spaced apart retaining hooks, two spaced apart side members respectively integral with said retaining hooks and extending upwardly and forwardly from said retaining hooks, said two retaining hooks and said two side members being spaced a distance sufficient to support the compound bow unit therein, a cross member extending transversely between and connected to said side members and having upturned end portions extending rearwardly which form guides to receive and retain the compound bow unit securely in the bow holder, two spaced apart forward members respectively integral with said side members to form two spaced apart arcuately convex lower members, and an arcuately convex lower plate cooperable with said arcuately concave upper surface of said base and connected to said spaced apart arcuately convex lower members, said lower plate containing an elongated slot, said upper assembly being adjustably secured to said base by said single fastener with said lower plate cooperating with said arcuately concave upper surface of said base, and said bow holder being further adjustably secured to said flat surface by said single fastener, said upper assembly including a sound deading an padded resilient coating disposed thereupon, thereby vibrations to said archery bow holder upper assembly being reduced.

* * * * *